US007731322B2

(12) United States Patent
Kogure et al.

(10) Patent No.: US 7,731,322 B2
(45) Date of Patent: Jun. 8, 2010

(54) IMAGE FORMING APPARATUS

(75) Inventors: Seiichi Kogure, Kanagwa (JP); Shinji Imoto, Tokyo (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 11/963,181

(22) Filed: Dec. 21, 2007

(65) Prior Publication Data

US 2008/0106566 A1 May 8, 2008

Related U.S. Application Data

(62) Division of application No. 10/561,329, filed on Dec. 19, 2005, now Pat. No. 7,334,858.

(30) Foreign Application Priority Data

Apr. 27, 2004 (JP) ..... 2004-131196

(51) Int. Cl.
*B41J 29/38* (2006.01)
*B41J 2/01* (2006.01)

(52) U.S. Cl. ..... 347/16; 347/104

(58) Field of Classification Search ..... 347/16, 347/104, 112, 154, 347
See application file for complete search history.

(56) References Cited

U.S. PATENT DOCUMENTS 5,255,904 A * 10/1993 Taguchi et al. ..... 271/18.1
6,600,894 B2 7/2003 Takahashi et al.
6,786,590 B2 9/2004 Maki et al.
7,264,347 B2 * 9/2007 Maki et al. ..... 347/104
2002/0126193 A1 9/2002 Maki et al.

FOREIGN PATENT DOCUMENTS

| | | |
|---|---|---|
| EP | 1238812 A1 | 9/2002 |
| JP | 4-201469 | 7/1992 |
| JP | 9-254460 | 9/1997 |
| JP | 2897960 | 3/1999 |
| JP | 2000-25249 | 1/2000 |
| JP | 3224528 | 8/2001 |
| JP | 2003-103857 | 4/2003 |
| JP | 2003-276881 | 10/2003 |

OTHER PUBLICATIONS

Mar. 3, 2008 Japanese Office Action in connection with related Japanese patent application No. JP2004-131196.

* cited by examiner

*Primary Examiner*—Stephen D Meier
*Assistant Examiner*—Kar Yip
(74) *Attorney, Agent, or Firm*—Copper & Dunham LLP

(57) ABSTRACT

An image forming apparatus can form a high-quality image while acquiring a stable conveyance performance. A conveyance belt (21) conveys a recording medium (12) by attracting the recording medium (12) by an electrostatic force. A recording head (7) discharges liquid droplets toward the recording medium (12) being conveyed by the conveyance belt (21). Alternating positive and negative electric charges are applied onto the conveyance belt (21). A conveyance speed is controlled in accordance with a charge period length of the alternating positive and negative electric charges applied onto the conveyance belt (21).

14 Claims, 12 Drawing Sheets

IMAGE FORMING APPARATUS

CROSS-REFERENCE TO RELATED APPLICATION

This application is a divisional of Ser. No. 10/561,329, filed Dec. 19, 2005 now U.S. Pat. No. 7,334,858, the entire contents of which are incorporated herein by reference.

TECHNICAL FIELD

The present invention relates to image forming apparatuses and, more particularly, to an image forming apparatus provided with a conveyance belt for conveying a recording medium.

BACKGROUND ART

There is known, for example, an inkjet recording apparatus as an image forming apparatus such as a printer, a facsimile or a copy machine apparatus. An inkjet recording apparatus performs recording by discharging ink droplets from a recording head onto a recording medium such as a recording paper (hereinafter, simply referred to as a "paper" but material is not limited to a paper). The inkjet recording apparatus is capable of recording a fine image at a high speed with advantages such as a low running cost, a low noise and an easy color image recording using multi-color ink.

In such an inkjet recording apparatus, it is required to increase a positional accuracy of landing positions of ink droplets on a paper so as to improve an image quality. There is known, such as disclosed in Japanese Laid-Open Patent Applications No. 4-201469, No. 9-254460 and No. 2000-25249, an inkjet recording apparatus that uniformly charges a conveyance belt to attract a paper by an electrostatic force to maintain a distance between a recording head and the paper constant, and to prevent an offset in a position of the paper by accurately controlling a paper feed, and to prevent a lift of the paper so as to prevent jamming and contamination of the paper due to a contact between the paper and the recording head.

However, it is known that when a conveyance belt is uniformly charged at a positive voltage to attract a paper by an electrostatic attraction force, ink droplets injected from a recording head are influenced by an electric field, which causes offsets in landing positions of the ink droplets on the paper and a reverse flow of ink mist toward the recording head.

In order to prevent offsets in landing positions of ink droplets and reverse flow of ink mist, there is known a charging method such as disclosed in Japanese Laid-Open Patent Application No. 2000-25249, in which ink droplets being injected is prevented from being influenced by an electric field by weakening a potential of a surface of a paper by applying an electric charge having a polarity opposite to a charge of a conveyance belt, of which surface is uniformly charged, on an upstream side of a recording head in the conveyance direction. Additionally, the paper is cause to be attracted by the conveyance belt by an electrostatic attraction force by weakening a potential of the surface of the paper having the same polarity as the surface of the conveyance belt.

Further, as a charging method of a conveyance belt, there is known a method such as disclosed in Japanese Patent No. 2897960, in which an alternating charge pattern is formed on the surface of the conveyance belt by applying positive and negative charges alternately onto the surface of the conveyance belt by causing a voltage applying means being brought in contact with the surface of the conveyance belt.

When attracting and retaining a paper by an electrostatic attraction force as mentioned above, an electric field is generated between a surface of the paper and the recording head and ink droplets discharged from a recording head are polarized due to an influence of the electric field. Thus, there is a problem in that a good recording cannot be achieved due to a turbulent flow and also ink mist generated by the flow of ink droplets may flow reversely and adhere to a head discharge part.

With respect to this problem, as disclosed in Japanese Patent No. 2897960, it was found that the electric field that is a cause of the offsets of landing positions of ink droplets and the reverse flow of ink mist can be weakened by applying alternating charges (positive and negative charges by an alternating current) onto a conveyance belt so as to generate an attraction force between the paper and the conveyance belt and simultaneously canceling the positive and negative charges by exchanging the positive and negative charges induced on the surface of the paper to reduce a potential of the surface of the paper.

That is, in order to weaken the electric field, a time period (hereinafter, referred to as a charge period length) of one cycle of an area where positive and negative charges are alternately applied may be reduced, that is, the charge period length formed by a pair of positive and negative charges may be shortened. This is because if the charge period length is shortened, a distance for the positive and negative electric charges to travel is reduced, which reduces a resistance giving an influence to the travel of the electric charges.

However, if a conveying speed is increased while reducing a charge width to weaken the electric field so as to aim at coexistence with improvement in the printing speed, which has become important in recent years, there is generated fluctuation of discharging area in a corona discharge area due to banding of a charge roller for charging the conveyance belt. Accordingly, electric charge cannot be applied stably and charge fluctuation occurs, which results in fluctuation in an attraction force necessary for conveying the paper, which consequently causes conveyance failure.

Additionally, there are problems in that: a sufficient charge cannot be applied to a conveyance belt since there is a limitation in the response speed of the output of a high voltage power supply; a failure may occur in the high-voltage power source if the conveyance speed is increased forcibly; and pin holes may be formed in the conveyance belt due to insulation destruction caused by a local high-voltage being generated.

SUMMARY

A more specific object of the present invention is to provide In an aspect of this disclosure, there is provided an image forming apparatus that can form a high-quality image while acquiring a stable conveyance performance.

In another aspect of this disclosure, there is provided an image forming apparatus comprising: a conveyance belt that conveys a recording medium by attracting the recording medium by an electrostatic force; and a recording head that discharges liquid droplets toward the recording medium being conveyed by the conveyance belt at a predetermined conveyance speed, wherein the image forming apparatus further comprises: charging means for applying alternating positive and negative electric charges onto the conveyance belt; and means for controlling a conveyance speed in accordance with a charge period length of the alternating positive and negative electric charges applied onto the conveyance belt.

In the above-mentioned image forming apparatus, since the conveyance speed is controlled in accordance with the charge period length of the positive and negative electric charges applied onto the conveyance belt, a stable application of the electric charges can be performed on the conveyance belt, and, both the attracting force necessary for conveyance and suppression of a surface potential can be achieved simultaneously. Additionally, a high-quality image can be stably formed without an offset in landing positions of liquid droplets and a reverse flow of liquid mist toward the recording head.

In another aspect of this disclosure, there is provided an image forming apparatus comprising: a conveyance belt that conveys a recording medium by attracting the recording medium by an electrostatic force; and a recording head that discharges liquid droplets toward the recording medium being conveyed by the conveyance belt at a predetermined conveyance speed, wherein the image forming apparatus further comprises: charging means for applying alternating positive and negative electric charges onto the conveyance belt; means for controlling a charge period of the positive and negative electric charges applied onto the conveyance belt; and means for controlling a conveyance speed in accordance with a charge period length of the positive and negative electric charges applied onto the conveyance belt, wherein the charge period length is adjusted by the means for controlling a charge period when the charge period length is equal to or longer than a predetermined length, and the conveyance speed is adjusted by the means for controlling a conveyance speed when the charge period length is shorter than a predetermined length.

In the above-mentioned image forming apparatus, since the charge period length is changed by adjusting the period of the positive and negative electric charges when the charge period length is equal to or longer than a predetermined charge period length, and the charge period length is changed by adjusting the conveyance speed when the charge period length is shorter than the predetermined charge period length, a stable application of the electric charges can be performed on the conveyance belt, and, both the attracting force necessary for conveyance and suppression of a surface potential can be achieved simultaneously. Additionally, a stable conveyance performance can be acquired, and a high-quality image can be stably formed without an offset in landing positions of liquid droplets and a reverse flow of liquid mist toward the recording head.

In the above-mentioned image forming apparatus, when the conveyance speed is higher than a speed corresponding to a predetermined value of the charge period length, the charging means may apply the positive and negative electric charges during a period from a state where the conveyance belt is stopped until a predetermined conveyance speed is reached. In the image forming apparatus according to the above-mentioned invention, when a predetermined conveyance speed for conveying the recording medium is higher than a conveyance speed corresponding to the predetermined period length, the charging means may apply the positive and negative electric charges during a period from a state where the conveyance belt is at the predetermined conveyance speed until the conveyance belt is stopped. In the image forming apparatus, when a predetermined conveyance speed for conveying the recording medium is higher than a conveyance speed corresponding to the predetermined period length, the charging means may apply the positive and negative electric charges during a period from a state where the conveyance belt is stopped until a predetermined conveyance speed is reached and a period from a state where the conveyance belt is at the predetermined conveyance speed until the conveyance belt is stopped. Additionally, in the image forming apparatus, the charging means may apply at least one or more pairs of the positive and negative electric charges.

In another aspect of this disclosure, there is provided an image forming apparatus comprising: a conveyance belt that conveys a recording medium by attracting the recording medium by an electrostatic force; and a recording head that discharges liquid droplets toward the recording medium being conveyed by the conveyance belt, wherein the image forming apparatus further comprises: charging means for applying alternating positive and negative electric charges onto the conveyance belt; and means for controlling a conveyance speed in accordance with an existence of the charges on the conveyance belt.

In the above-mentioned image forming apparatus, since the conveyance speed is controlled in accordance with an existence of the positive and negative electric charges applied onto the conveyance belt, an attempt can be made to increase a printing speed.

Other aspects, features and advantages will become more apparent from the following detailed description when read in conjunction with the accompanying drawings.

BEST MODE FOR CARRYING OUT THE INVENTION

A description will now be given, with reference to the accompanying drawings, of embodiments according to the present invention.

Figure 1:
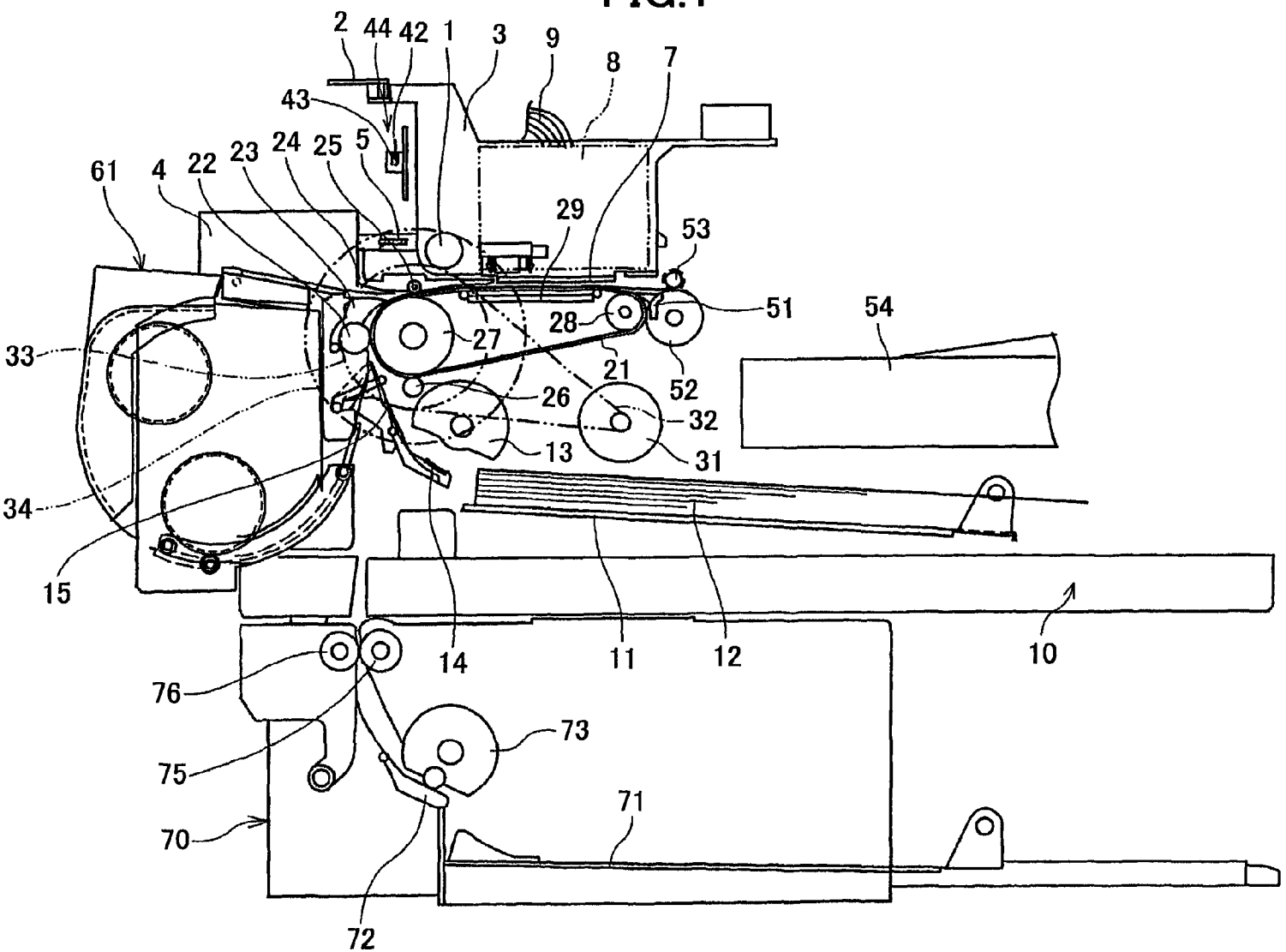
FIG. 1 is an illustrative side view of an image forming apparatus according to the present invention.
Figure 2:
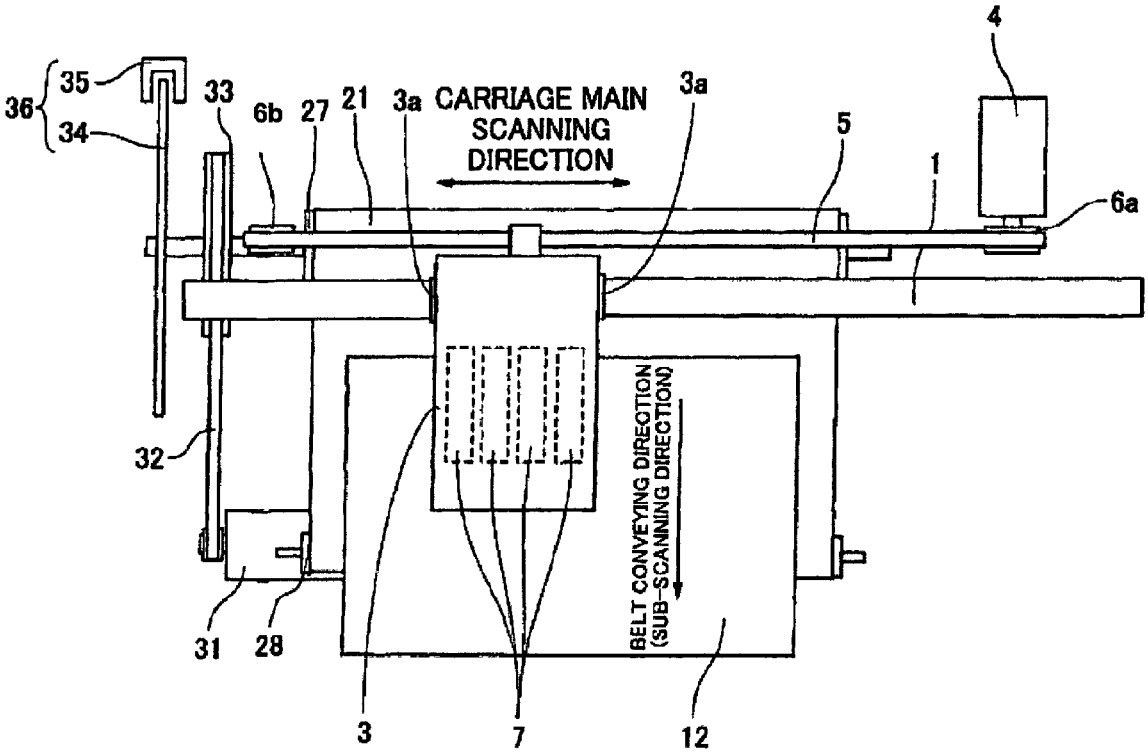
FIG. 2 is a plan view of a part of the image forming apparatus shown in FIG. 1.

First, a description will be given, with reference to FIGS. 1 and 2, of an image forming apparatus according to a first embodiment of the present invention. FIG. 1 is an illustrative side view of the image forming apparatus. FIG. 2 is a plan view of a part of the image forming apparatus shown in FIG. 1.

In the image forming apparatus shown in FIG. 1, a carriage 3 is slidably supported by a guide rod 1 and a guide rail 2 that bridge between left and right side plates (not shown in the figure) in a main scanning direction so that the carriage 3 is moved to scan in directions of arrows (the main scanning direction) in FIG. 2 by a main scanning motor via a timing belt being engaged with a drive pulley 6*a* and an idle pulley 6*b*. It should be noted that guide bushings (bearings) 3*a* are interposed between the carriage 3 and the guide rod 1, respectively.

Four recording heads 7 which consist of liquid droplet discharge heads, which discharge ink droplets of yellow (Y), cyan (C), magenta (M) and black (Bk), are arranged so that a plurality of ink discharge ports are arranged in a direction perpendicular to the main scanning direction and ink droplet discharge direction is directed downward.

The inkjet head constituting the recording head 7 may be of a piezoelectric actuator type using a piezoelectric element, a thermal actuator type using a phase change caused by film boiling of a liquid by an electrothermal transforming element, a shape memory alloy actuator type using metal phase change caused by a temperature change, an electrostatic actuator type using an electrostatic force, etc. It should be noted that the recording head may be constituted by one or more liquid discharge heads each having a plurality of nozzle trains discharging different color ink.

Sub-tanks 8 for each color are mounted on the carriage 3 so as to supply ink of each color to the recording head 7. Ink is supplied to each of the sub-tanks 8 from a main-tank (ink cartridge) through ink supply tubes 9. It should be noted that a recording head which discharges a fixing process liquid for improving fixation of ink by reacting with the recording liquid (ink) may be provided other than the recording head 7 for discharging ink droplets.

Additionally, there is provided, as a conveyance part for conveying the recording papers 12 fed from the paper feed part under the recording head 7, a conveyance belt 21, a counter roller 22, a conveyance guide 23 and an end press roller 25. The conveyance belt 21 conveys the recording papers 12 by attaching thereto by an electrostatic force. The counter roller 22 conveys each recording paper 12, which is fed from the paper feed part through a guide 15, by sandwiching each recording paper 12 with the conveyance belt 21. The guide 23 causes each recording paper 12 being fed upwardly to turn by about 90 degrees so that each recording paper 12 follows the conveyance belt 21. The end press roller 25 is urged toward the conveyance belt 21 by a press member 24. Additionally, a charge roller 26 is provided, which is charge means for electrically charging a surface of the conveyance belt so as to generate an electrostatic attraction force.

The conveyance belt 21 is an endless belt (originally formed as an endless belt or may be formed by connecting opposite ends of a belt), which is engaged with a conveyance roller 27 and a tension roller 28 so as to be rotated in a belt conveyance direction in FIG. 2 (sub-scanning direction) by the conveyance roller 27 being rotated by a sub-scanning motor 31 via a timing belt 32 and a timing roller 33. It should be noted that a guide member 29 is arranged in correspondence with an image forming area by the recording head on the reverse side of the conveyance belt 21.

Figure 3:
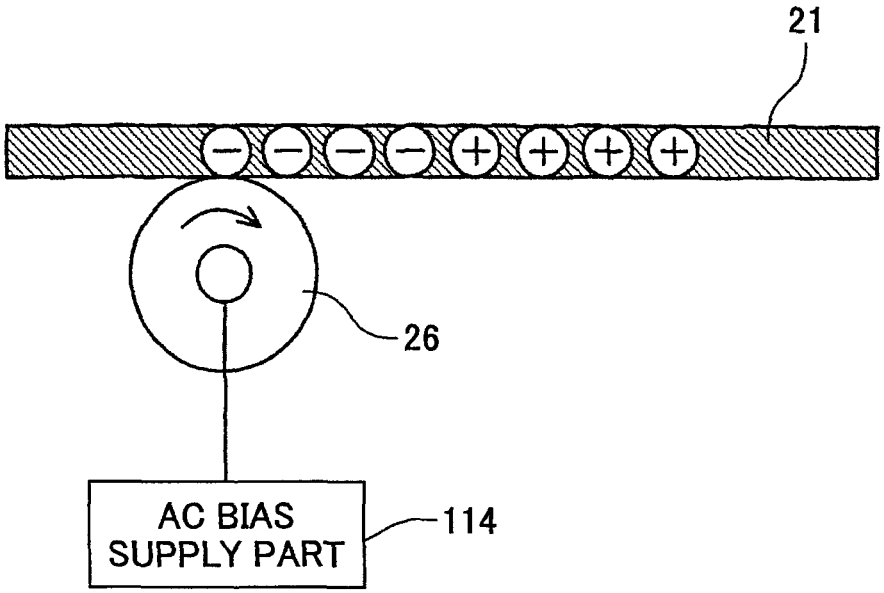
FIG. 3 is an illustration showing a layered structure of an example of a conveyance belt shown in FIG. 1.
Figure 4:
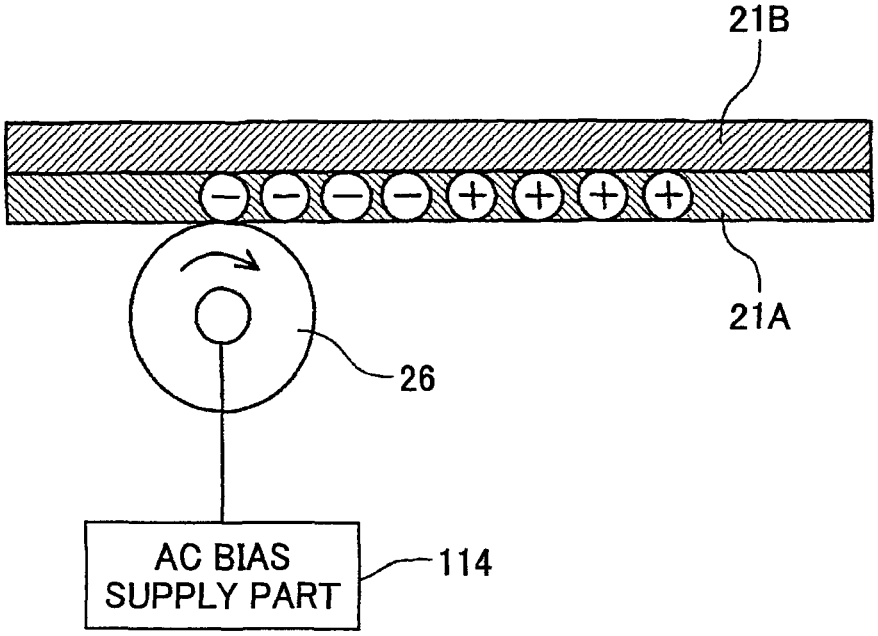
FIG. 4 is an illustration showing a layered structure of another example of the conveyance belt shown in FIG. 1.

As the conveyance belt 21, a belt of a single-layered structure may be used as shown in FIG. 3, or a belt having a multi-layered structure may be used as shown in FIG. 4. If the conveyance belt 21 of a single-layered structure is used, an entire layer is formed of an insulating material since the conveyance belt 21 is brought into contact with the recording paper 12 and the charge roller 26. Moreover, if the conveyance belt 21 of a multi-layered structure is used, it is preferable to form an insulating layer 21 on a side which is brought into contact with the recording paper 12 and the charge roller 26, and a conductive layer 21B on a side which is not brought into contact with the recording paper 12 and the charge roller 26.

As for the insulating material for forming the conveyance belt 21 having the single-layered structure and the insulating layer 21A of the conveyance belt 21 having the multi-layered structure, it is preferable to use a material such as a resin or an elastomer such as PET, PEI, PVDF, PC, ETFE or PTFE and does not contain a conductivity control material. Additionally, a volume resistivity of the material may be equal to or higher than $10^{12}$ Ωcm, preferably, be $10^{15}$ Ωcm. Moreover, as for a material to form the conductive layer 21B of the conveyance belt 21 having the multi-layered structure, it is preferable to set a volume resistivity from $10^5$ to $10^7$ Ωcm by mixing carbon into the above-mentioned resin or elastomer.

The charge roller 26 is brought into contact with the insulating layer 21A forming a front layer of the conveyance roller 21 (in a case of the multi-layered belt) and is rotated by the movement of the conveyance belt 21 so as to apply a pressing force to opposite ends of the shaft. The charge roller 26 is formed by a conductive member having a volume resistivity of $10^6$ to $10^9$ Ωcm. For example, positive and negative AC bias (high voltage) of 2 kV is applied from an AC bias supply part (high-voltage power source) 114 to the charge roller 26 as mentioned later. Although the AC bias can be a sinusoidal wave or a triangular wave, a square wave is more preferable.

Moreover, as shown in FIG. 2, a slit disc 34 is attached to the shaft of the conveyance roller 27, and a sensor 35 is provided to detect slits of the slit disc 34 so that an encoder 36 is formed by the slit disc 34 and the sensor 35.

Moreover, an encoder scale 42 having slits is provided on the front side of the carriage 3, as shown in FIG. 1, and an encoder sensor 43 comprising a transmission type photo sensor is provided on the front side of the carriage 3 to detect the slits of the encoder scale 42 so that an encoder 44 is formed to detect a position of the carriage 3 in the main scanning direction.

Further, as a paper eject part for ejecting the recording paper 12 recorded by the recording head 7, there are provided a separation claw 51 for separating each recording paper 12 from the conveyance belt 21, paper eject rollers 52 and 53, and a paper eject tray 54 for accommodating the ejected recording paper 12.

Additionally, a double-side paper feed unit 61 is detachably attached to a backside of the inkjet recording apparatus. The double-side paper feed unit 61 takes each recoding paper 12 returned by reverse rotation of the conveyance belt 21 and turns over the returned recording paper 12, and feeds the recording paper 12 to a position between the counter roller 22 and the conveyance belt 21.

Further, an expansion tray 70 can be attached to the bottom the image forming apparatus as shown in FIG. 1. The expansion tray 70 comprises, similar to the paper supply tray 10, a press plate (paper placement plate) 71 on which recording papers 12 are placed, a paper supply roller 73 and a separation pad 72. When supplying recording papers from the expansion tray 10, the recording papers are fed one by one by the paper supply roller 73 and the separation pad 72 and, then, the recording papers are fed by conveyance rollers 75 and 76 to a position between the counter roller 22 and the conveyance belt 21 from under the apparatus body.

In the inkjet recording apparatus having the above-mentioned structure, each recording paper 12 is separated and fed from the paper supply part, each recording paper 12 being fed upwardly in a vertical direction is guided by the guide 15, each recording paper 12 is conveyed while being sandwiched between the conveyance belt 21 and the counter roller 22, and, then, the end of each recording paper 12 is guided by the conveyance guide 23 and pressed against the conveyance belt 21 by the end press roller 25 so as to change the direction of conveyance by about 90 degrees.

At this time, an alternating voltage is applied to the charge roller 26 from a high-voltage source so that a positive output and a negative output are repeatedly applied to the charge roller 26. Thus, the conveyance roller 21 is charged in an alternating charge voltage pattern so that plus and minus charges are alternately arranged in the sub-scanning direction, which is a rotational direction of the conveyance belt 21. When the recording paper 12 is fed onto the conveyance belt 21, which is charged in the alternating plus and minus pattern, the recording paper 12 is attracted by the conveyance belt 21 by an electrostatic force, and, thereby, the recording paper 12 is conveyed by the conveyance belt 21 rotating in the sub-scanning direction.

Thus, recording of one line is performed by ejecting ink droplets onto the recording paper 12, when the recording paper is stopped, by driving the recording head 7 in accordance with image signals while moving the carriage 3, and, then, recording of a next line is performed after conveying the recording paper by a predetermined distance. Upon receipt of a recording end signal or a signal which indicates that a trailing edge of the recording paper 12 reached the recording area, the recording operation is ended, and the recording paper 12 is ejected onto the paper eject tray 54.

In a case of double-side print, the conveyance belt 21 is reversed after completion of the recording of a front side (surface printed first) so as to send the recorded recording paper 12 to the double-side paper feed unit 61. Thereafter, the recording paper 12 is turned over (set the backside to be a surface to be printed) and is fed to a position between the counter roller 22 and the conveyance belt 21. Then, recording of the backside is performed by conveying the recording paper 12 to the conveyance belt 21 while performing a timing control, and, thereafter the recording paper 12 is ejected onto the paper eject tray 54.

Figure 5:
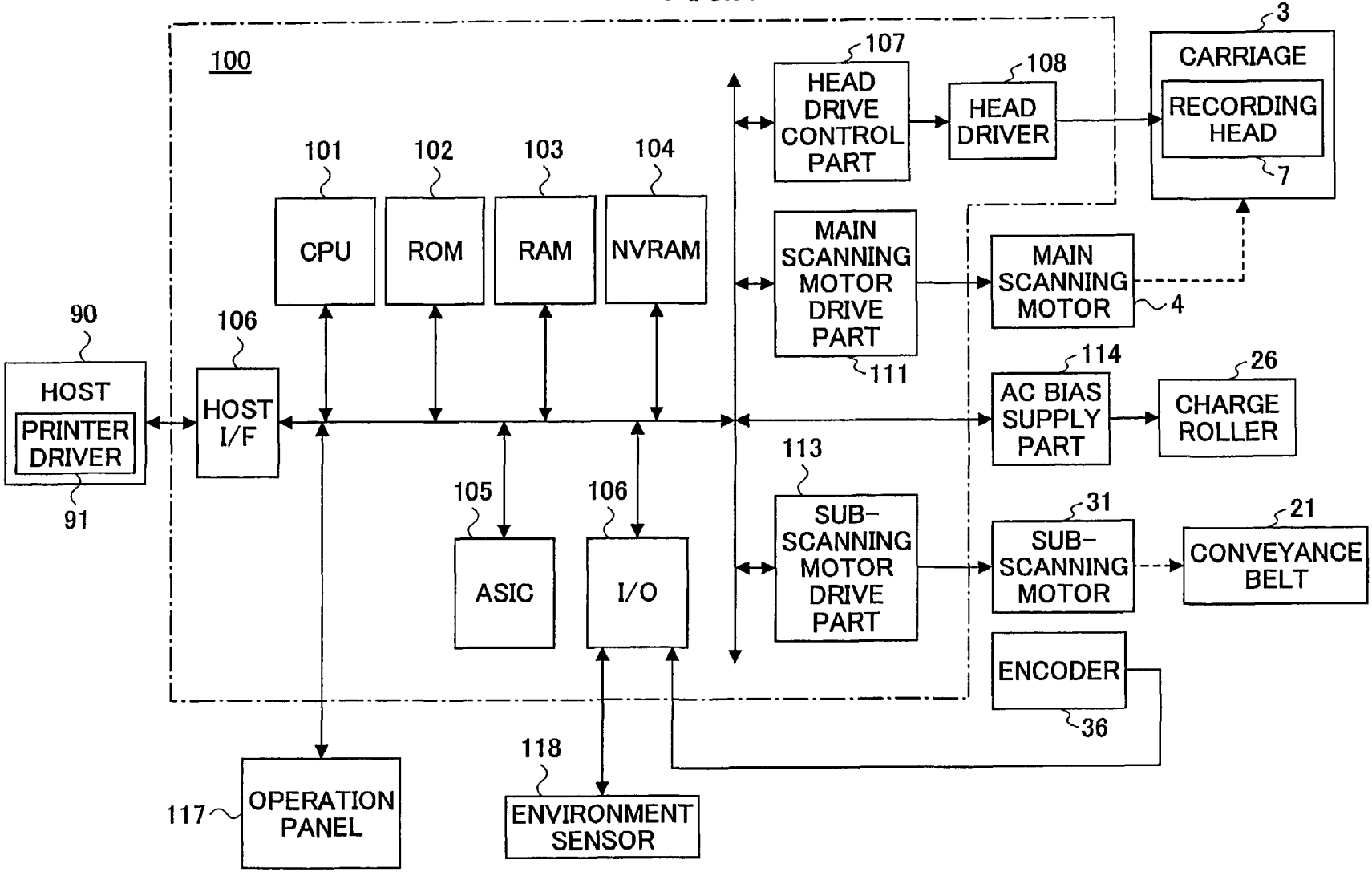
FIG. 5 is a block diagram of an entire control part of the inkjet recording apparatus shown in FIG. 1.

A description will now be given, with reference to FIG. 5, of a control part of the inkjet recording apparatus. FIG. 5 is a block diagram of the entire control part of the inkjet recording apparatus shown in FIG. 1.

The control part 100 comprises: a central processing unit (CPU) 101 which controls the entire apparatus; a read only memory (ROM) 102 for storing programs executed by the CPU 101 and other fixed data; a random access memory (RAM) 103 for temporarily storing image data; a rewritable non-volatile memory 104 for retaining data while the power of the apparatus is turned off; and an application specification integrated circuit (ASIC) 105 for performing image processing including various signal processing and rearrangement on the image data and input and output signal processing from controlling the entire apparatus.

Additionally, the control part 100 comprises: an interface (I/F) 106 for exchanging data and signals with a host side 90 which is a data processing apparatus such as a personal computer; a head drive control part 107 and a head driver 108 for controlling drive of the recording head 7; a main scanning motor drive part 111 for driving the main scanning motor 4; a sub-scanning motor drive part 113 for driving the sub-scanning motor 31; and an interface (I/O) 116 for inputting detection signals from an the encoder 34, an environment sensor 118, which detects an environmental temperature and/or environmental humidity, the above-mentioned encoder 44 (not shown in the figure), and other various sensors.

The control part 100 is connected with an operation panel 117 for inputting and displaying information necessary for the apparatus. Additionally, the control part 100 performs on and off operations of an output of an AC bias supply part 114, which applies an AC bias to the charge roller 26.

The control part 100 receives print data from the host side by the I/F 106 through a cable or a net, the print data containing image data from a data processing apparatus such as a personal computer, an image reading apparatus such as an image scanner or an image taking apparatus such as a digital camera. It should be noted that creation of the print data supplied to the control part 100 is performed by a printer driver 91 of the host side 90.

The CPU 101 reads and analyzes the print data stored in a receiver buffer included in the I/F 106, and causes the ASIC 105 to rearrange the data and, then, transfers the image data to the head drive control part 107. It should be noted that although the image data is developed to bit map by the printer driver 91 and transferred to the apparatus, the conversion of the image data to the bit map data may be performed according to, for example, font data stored in the ROM 102.

The head drive control part 107 sends, after acquiring the image data (dot-pattern data) corresponding to one line of the recording head, the dot-pattern data as serial data corresponding to one line to the head driver 108 in synchronization with a clock signal, and also sends a latch signal to the head driver 108 at a predetermined timing.

The head drive control part 107 includes a ROM (may be constituted by the ROM 102) which stores pattern data of a drive waveform (drive signal) and a drive waveform generation circuit which has an amplifier and a waveform generation circuit including a D/A converter, which converts the drive waveform data read from the ROM.

The head driver 108 comprises: a shift register which inputs the clock signal and the serial data, which is serial data, sent from the head drive control part 107; a latch circuit which latches a register value of the shift register by a latch signal from the head drive control part 107; a level conversion circuit (level shifter) which carries out level change of the output value of the latch circuit; and an analog switch array (switch means) which is turned on and off by the level shifter. The head driver 107 selectively applies a desired drive waveform contained in the drive waveform to the recording head 7 by controlling on/off of the analog switch array.

The main scanning motor drive part 111 computes a control value based on a target value given by the CPU 101 and a speed detection value acquired by sampling detection pulses from the encoder 44, and drives the main scanning motor 4 via an internal motor driver.

Similarly, the sub-scanning motor drive part 113 computes a control value based on a target value given by the CPU 101 and a speed detection value acquired by sampling detection pulses from the encoder 35, and drives the sub-scanning motor 31 via an internal motor driver.

Figure 6:
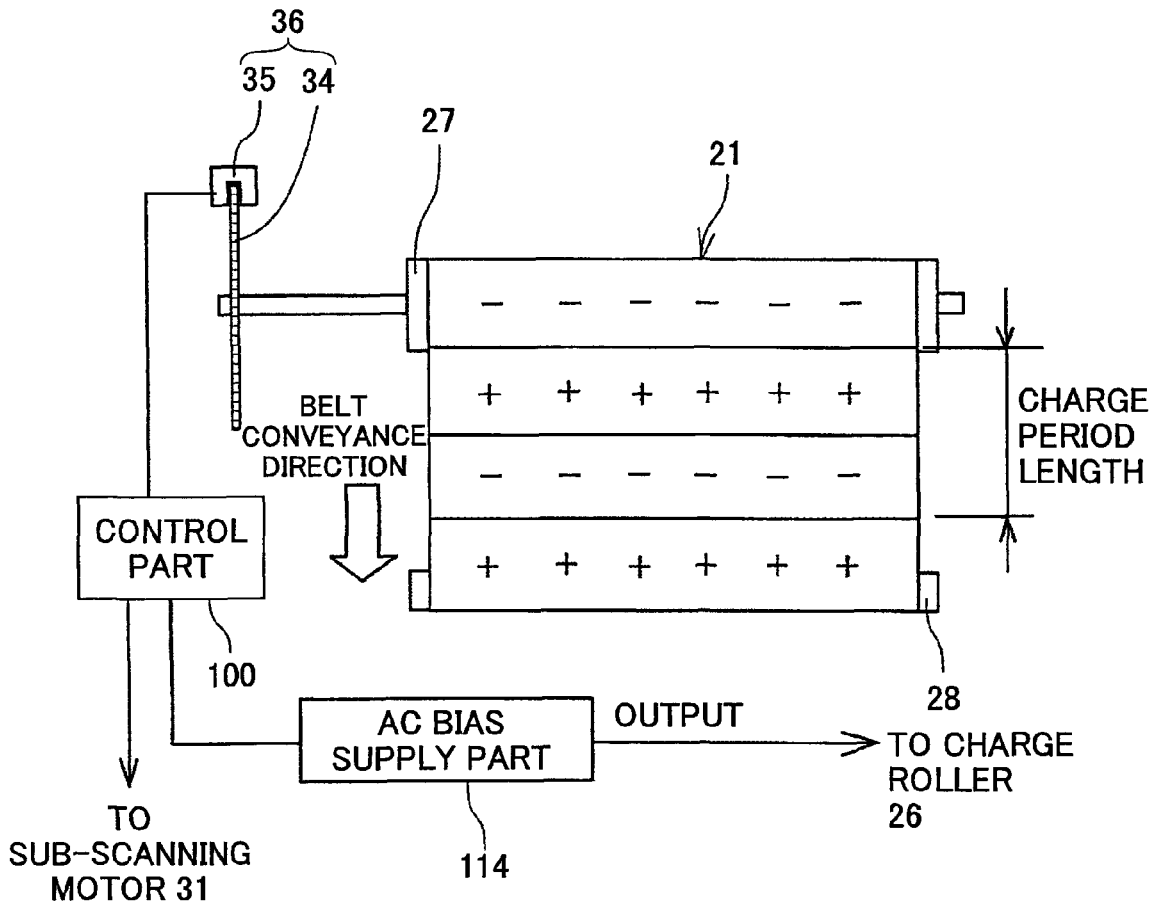
FIG. 6 is an illustration of a part relating to a charge control.

A description will be give, with reference to FIG. 6, of a part relating to a charge control to the conveyance belt 21 in the image forming apparatus. FIG. 6 is an illustration of the part relating to the charge control. As mentioned above, an amount of rotation is detected by the encoder 36 provided at the end of the conveyance roller 27 which drives the conveyance belt 21 so that the sub-scanning motor 31 is controlled by the control part and the above-mentioned sub-scanning motor drive part 113 and the output of the AC bias supply part 114, which applies a high-voltage (AC bias) to the charge roller 26 in accordance with the detected amount of rotation.

A period (apply time) of the positive and negative voltage applied to the charge roller 26 is controlled by the AC bias supply part 114, and, simultaneously, positive and negative electric charges are applied onto the conveyance belt 21 at a predetermined charge period length by the control part 100. Additionally, the control part 100 controls the AC bias supply part 114 to change the period of the applied voltage output from the AC bias supply part 114. That is, in the present embodiment, the control part 100 serves as both control means for controlling the charge period of positive and negative electric charges applied to the conveyance belt 21 and control means for controlling a conveyance speed of the conveyance belt 21 in accordance with the charge period length of the positive and negative charges applied to the conveyance belt 21.

Here, as mentioned above, when starting printing, the conveyance belt is rotated clockwise in FIG. 1 by driving the conveyance roller 27 by the sub-scanning motor 32, and, at the same time, a square wave is applied from the AC bias supply part 114 to the charge roller 26. Thus, since the charge roller 26 is in contact with the insulating layer 21A of the conveyance belt 21, the positive and negative charges are applied alternately in a belt-like pattern in the conveyance direction of the conveyance belt 21 onto the insulating layer 21A of the conveyance belt 21, as shown in FIG. 6. It should be noted that the term "charge period length" means a length (width) of a pair of positive and negative charge patterns adjacent to each other as shown in the figure.

Since the insulating layer 21A of the conveyance belt 21 to which the positive and negative charges are applied is formed so that a volume resistivity thereof is equal to or higher than $10^{12}$ Ωcm, preferably, $10^{15}$ Ωcm as mentioned above, the positive and negative charges on the insulating layer 21A are prevented from moving at the boundary therebetween, which maintains the positive and negative charges on the insulating layer 21A.

Then, when the recording paper 12 as a recording medium is separated by the paper supply roller 13 and the separation pad 14 and the recording paper 12 is fed to the conveyance belt 21 in which an uneven electric field is generated by the positive and negative charges formed on the insulating layer 21A, a polarization occurs instantaneously in the recording paper 12 in a direction of the electric field and the recording paper 12 is attracted by the conveyance belt 21. Simultaneously, electric charges are induced on the attracted surface of the recording paper 12 and the reverse surface thereof.

Although the charges induced at the attracted surface side of the recording paper 12 and the charges applied on the conveyance belt 21 are stable by being attracted by each other, the charges induced on the reverse side are unstable.

The positive and negative electric charges induced on the surface of the recording paper opposite to the attracted surface are cancelled with each other and reduced by the adjacent electric charges being exchanged with respect to passage of time on the surface of the recording paper 12 since the surface resistivity of the recording paper 12 is as small as $10^7$Ω/□ to $10^{13}$Ω/□. As a result, the recording paper 12 is strongly attracted by the conveyance belt 21.

Here, an amount of the charges on the surface of the recording paper and a time until extinction of the charges depend on the surface resistivity of the recording paper 12 and the charge period length of the positive and negative charges applied on the conveyance belt 21. When the surface resistivity of the recording paper 12 is high, it takes a long time until the charges on the surface of the recording paper disappear. Additionally, when a charge period length on the conveyance belt 21 is small, the time until the charges disappear is short since the resistance is small.

Therefore, when the surface resistance of the recording paper 12 is high, the time until the charges disappear can be reduced by reducing the charge period length.

According to experiments performed by the inventors, it was confirmed that when the recording paper 12 having a surface resistivity of a range from $10^{11}$Ω/□ to $10^{13}$Ω/□ is conveyed to a position directly under the recording head 7 as an image forming part at a conveyance speed of 200 mm/sec, the surface potential of the recording paper was able to be reduced at a value equal to or smaller than 400 V/1 mm in a peak to peak of the positive and negative potentials (an absolute value of Max-Min: hereinafter, referred to as "p-p"), which can prevent the head plane from being polluted due to an offset in landing positions of ink droplets or rebound of ink mist.

Moreover, it was found that when the recording paper having a relatively high surface resistivity of equal to or higher than $10^{12}$Ω/□ was conveyed to a position directly under the recording head 7 at a conveyance speed of 200 mm/sec, an electric charge of equal to or higher than 600 V/1 mm is remained, which generates pollution of the head surface due to an offset in the landing positions of ink and a reverse flow of ink mist.

However, if the charge period length is reduced, a contribution ratio of a raising loss of the AC bias supply part (high-voltage power source) 114 and a discharge loss generated when applying a charge to the conveyance belt 21 is increased, which makes it difficult to apply a sufficient electric charge onto the conveyance belt 21.

Here, the raising loss of the AC bias supply part 114 is a loss caused by lack of raising when a voltage switches. The AC bias supply part (AC bias feeder) 114 used in the present embodiment requires, for example, 10 msec until the voltage is raised from 0 to ±2 kV, and if the conveyance speed is, for example, 200 mm/sec, a distance of movement of the conveyance belt 21 until raising of the voltage is 2 mm.

Therefore, a period for applying a sufficient charge of ±2 kV must be set by a frequency F of the positive and negative voltages being set equal to or smaller than 25 (Hz), that is, the charge period length a must be equal to or longer than 8 mm. Therefore, when the charge period length a is set to smaller than 8 mm, a sufficient charge cannot be applied to the conveyance belt 21. For this reason, if the charge period length a is set smaller than 8 mm, an influence of the raising loss of the AC bias supply part 114 can be reduced by reducing the conveyance speed.

For example, the conveyance speed V (mm/sec) can be represented by "V=a×F" where a is a charge period length (mm), F is a frequency (Hz) of positive and negative voltages applied, and a raising limit frequency is 25 Hz.

Moreover, if an attempt is made to forcibly raise the voltage, there may be a case where the AC bias supply part 114 outputs a voltage higher than a setting voltage, which results in insulation destruction due to generation of a local high-voltage. Thus, there is a problem in that pin holes are formed in the conveyance belt 21. Although this problem may be solved by using the AC bias supply part 114, which can decrease the raising time, such a method is not a practical selection for a compact and low-cost machine since it may cause an increase in the size, the power supply capacity and power consumption of the AC bias supply part 114.

Figure 7:
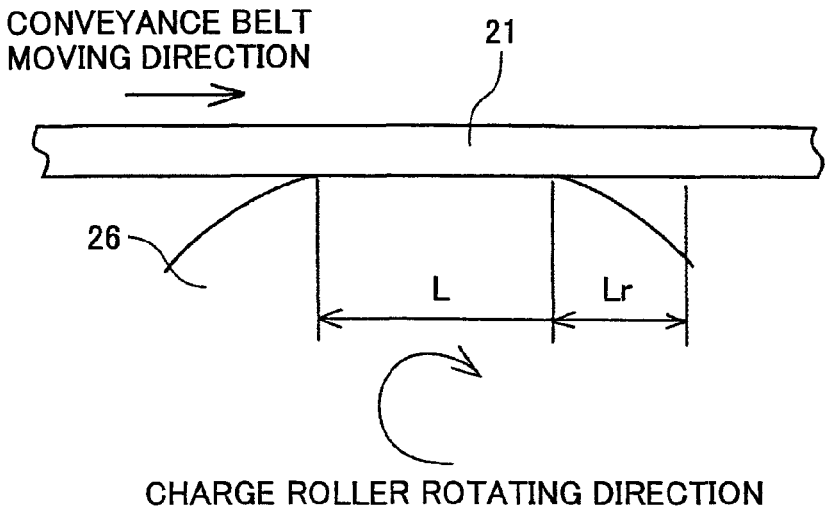
FIG. 7 is an illustration for explaining a discharge loss occurring when a charge is applied to a conveyance belt.

The discharge loss generated when applying a charge loss caused by a corona discharge generated when a charge is applied. The application of the positive and negative charges from the charge roller 26 to the conveyance belt 21 is performed within a nip (indicated by L in the figure) where the charge roller 26 and the conveyance belt 21 contact with each other, as shown in FIG. 7.

When the polarity of the voltage applied to the charge roller 26 is switched, a corona discharge, which cancels the already applied charge, may occur in a corona discharge area Lr on a downstream side of the nip portion before the polarity is changed, thereby discharging the charge applied onto the surface of the conveyance belt 21. This discharge loss is greatly influenced by a fluctuation of the nip of the charge roller 26, and if the charge period length is reduced, the influence is not negligible. In order to reduce the influence, it is effective to reduce the conveyance speed. This is because a fluctuation of a nip becomes small since banding of the charge roller 26 can be suppressed if the conveyance speed is low.

Thus, these problems can be solved by changing (adjusting) the conveyance speed in accordance with the charge period length of the positive and negative charges applied on the conveyance belt 21. That is, the time required for raising the voltage can be acquired by reducing the conveyance speed so that a sufficient charge can be applied to the conveyance belt 21. Thus, it becomes possible to suppress the surface potential at a position directly under the recording head 7 while acquiring an attraction force sufficient for conveyance.

Figure 8:
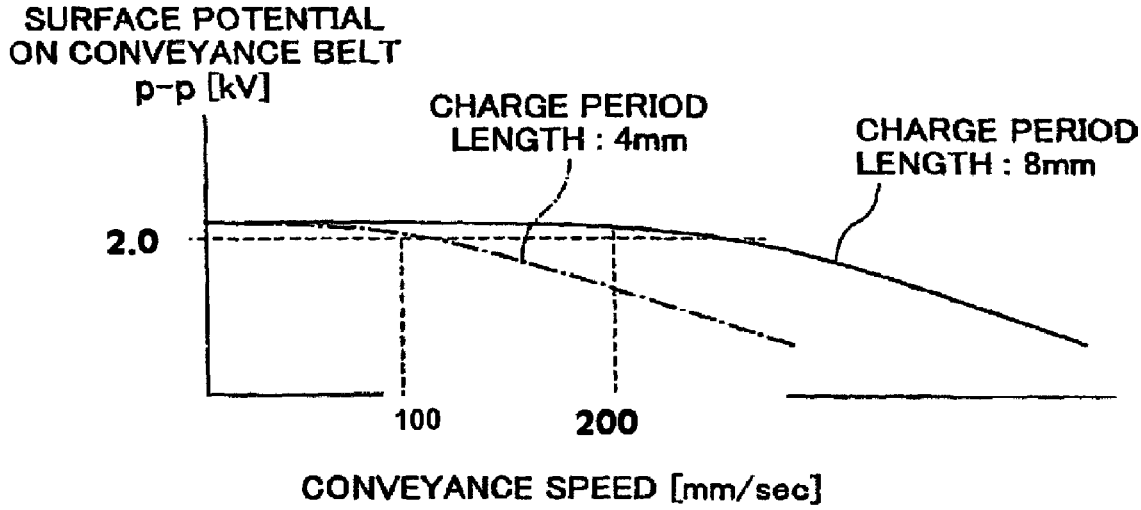
FIG. 8 is a graph showing an example of a relationship between a conveyance speed, a charge period length and a surface potential on a conveyance belt.

According to experiments, in a case of the applied voltage of ±2 kV, as shown in FIG. 8, the surface potential P-P of 2 kV/1 mm was obtained on the conveyance belt 21 at which an attraction force necessary for conveyance can be acquired by conveying at a speed equal to or lower than 100 mm/sec when the charge period length is 4 mm and at a speed equal to or lower than 200 mm/sec when the charge period length is 8 mm.

Thus, by changing the conveyance speed in accordance with the charge period length of the positive and negative charges applied to the conveyance belt, a time taken for raising a voltage can be acquired. Accordingly, there is no destruction of the high-voltage power source (AC bias supply apparatus) and no generation of pin holes in the conveyance belt. Additionally, stable charges having no fluctuation can be applied onto the conveyance belt, which achieves an attraction force necessary for conveyance. Thus, by suppressing the surface potential while acquiring a stable conveyance performance, a high-quality image can be stably formed without an offset of landing positions of ink droplets and a reverse flow of ink mist.

Moreover, as mentioned above, by changing the charge period length by adjusting the period (charge time) of the positive and negative charges when the charge period length is equal to or longer than a predetermined value, and by changing the charge period length consequently by adjusting the conveyance speed when the charge period is shorter than the predetermined value, stable charges can be applied onto the conveyance belt, and the suppression of the surface potential can be achieved while acquiring a necessary attraction force for conveyance to maintain a stable conveyance performance. Thus, a high-quality image can be stably formed without an offset of landing positions of ink droplets and a reverse flow of ink mist.

That is, if the charge period length of the positive and negative charges applied onto the conveyance belt is equal to or greater than a predetermined value, that is, if the period corresponds to a frequency equal to or lower than a predetermined frequency, an output of the high-voltage power source can raise sufficiently and charges necessary for conveyance can be applied onto the conveyance belt. However, if the charge period length of the positive and negative charges applied onto the conveyance belt is smaller than a predetermined value, that is, if the period corresponds to a frequency higher than the predetermined frequency, the output of the high-voltage power source cannot raise sufficiently and charges necessary for conveyance cannot be applied onto the conveyance belt.

Thus, by moving the conveyance belt at a predetermined conveyance speed when the charge period length is equal to or greater than a predetermined value, and by changing the charge period length by adjusting the charge period (charge time) of the positive and negative charges to be applied, and by fixing the charge period of the positive and negative charges to a predetermined period when the charge period length is smaller than a predetermined value, and by changing the charge period length by adjusting the conveyance speed, while attempting a high speed printing, a stable application of charges onto the conveyance belt is performed. Additionally, a stable application of charges onto the conveyance belt is performed without fluctuation, and by performing suppression of the surface potential while acquiring an attraction force necessary for conveyance to maintain a stable conveyance performance, a high-quality image can be stably formed without an offset of landing positions of ink droplets and a reverse flow of ink mist.

Figure 9:
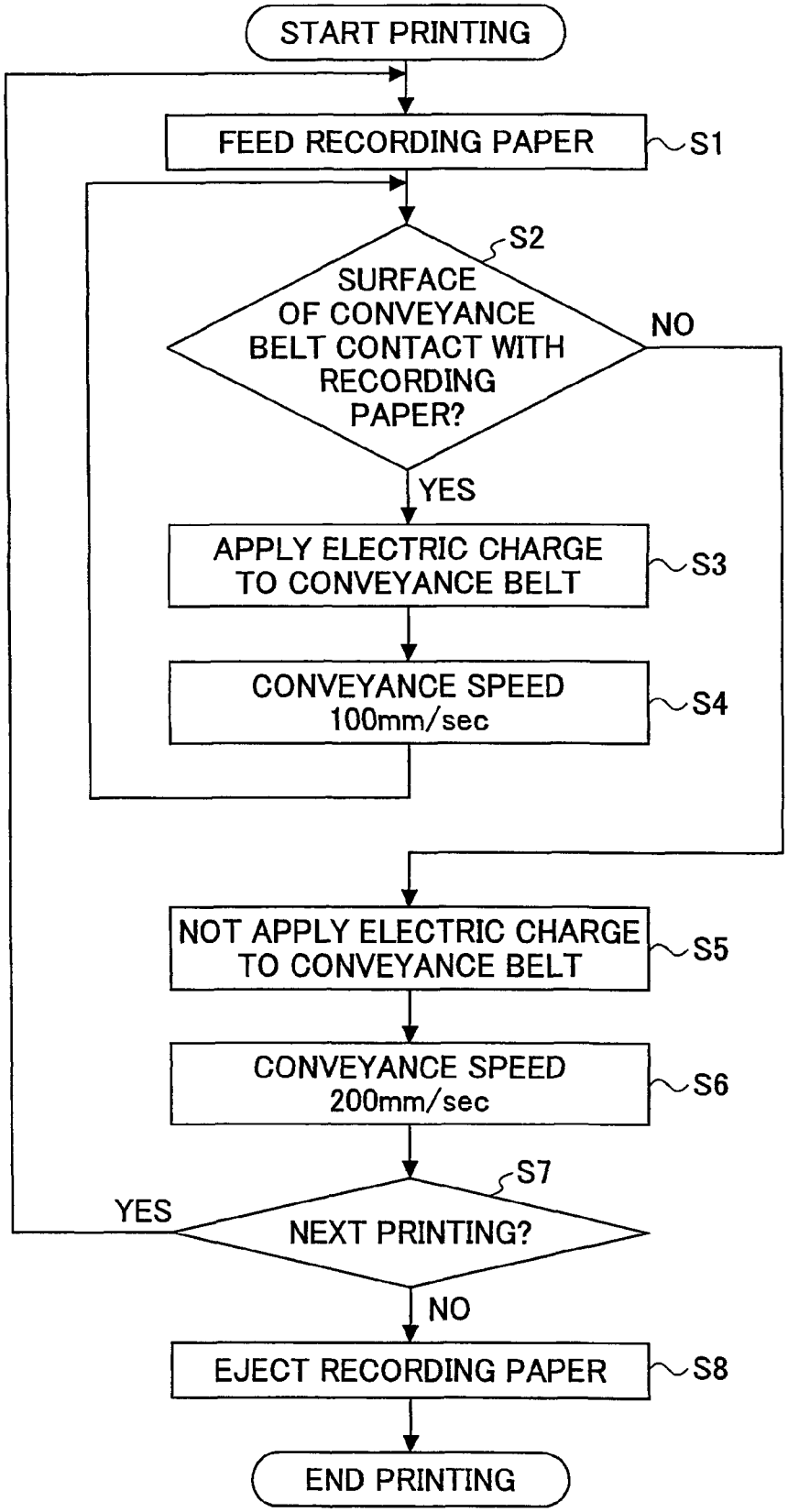
FIG. 9 is a flowchart of a printing process of an image forming apparatus according to a second embodiment of the present invention.
Figure 10:
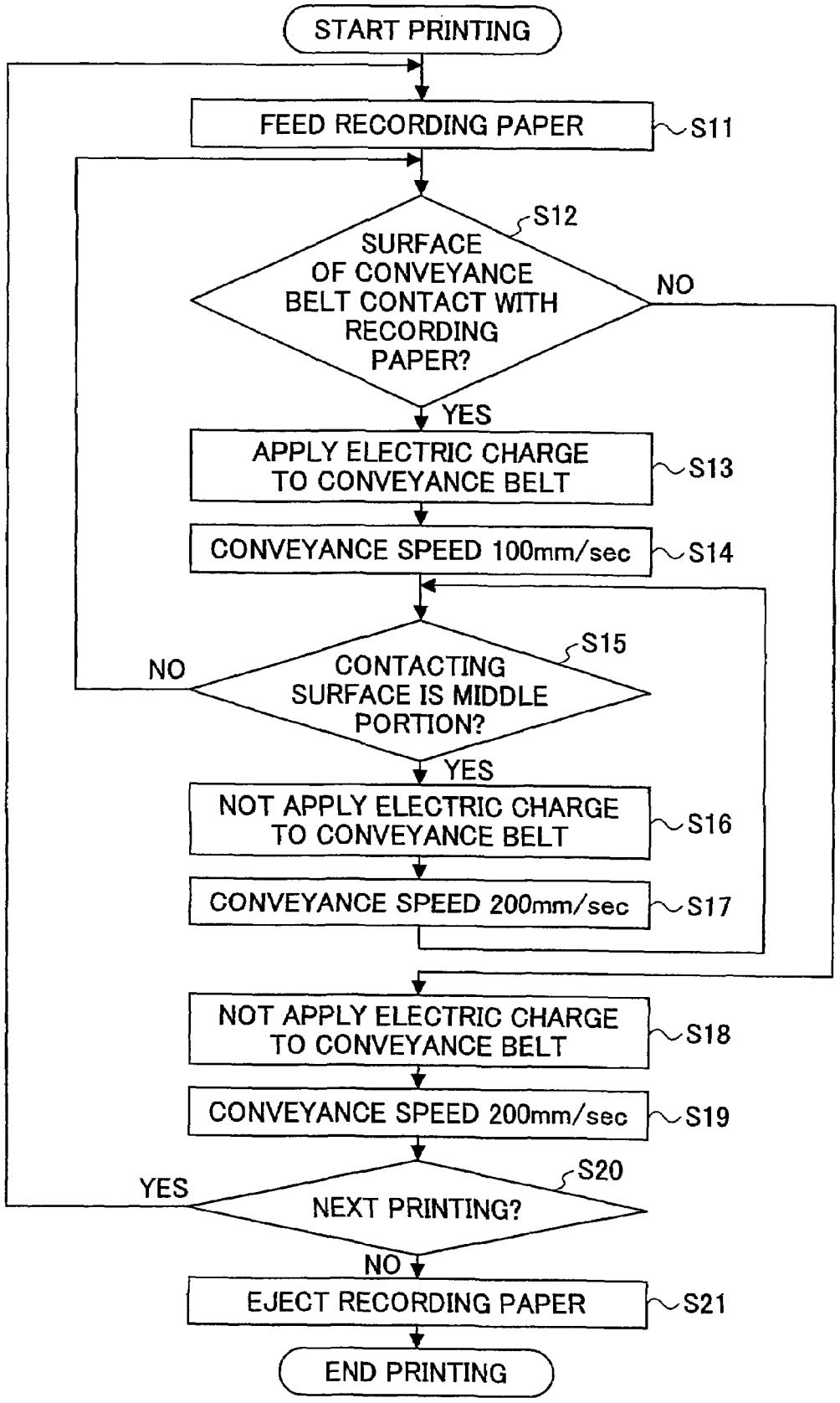
FIG. 10 is a flowchart of another printing process of the image forming apparatus according to the second embodiment of the present invention.

A description will now be given, with reference to FIGS. 9 and 10, of a conveyance belt charge control in an image forming apparatus according to a second embodiment of the present invention. In the above-mentioned first embodiment, an attempt is made to achieve both the attraction force necessary for conveyance and suppression of the surface potential at a position directly under the recording head by changing the conveyance speed in accordance with a charge period length. However, in the second embodiment, the conveyance speed is changed in accordance with an existence of a charge applied to the conveyance belt 21. It should be noted that the structure of the image forming apparatus according to the second embodiment is the same as that of the first embodiment except for detection means (sensor) being provided for detecting a leading edge and a trailing edge of a recording paper (recording medium) being fed so as to detect a relative position between the recording paper and electric charge on the conveyance belt, and descriptions of the same parts will be omitted.

That is, when using a high-resistance paper which requires slow down of the conveyance speed to a speed lower than a predetermined conveyance speed, a relative position between the recording paper 12 and the charge applied to the conveyance belt 21 is detected by detecting a leading and trailing edges of the recording paper by detecting means (sensor) for detecting a leading edge and a trailing edge of a recording paper so as to attempt speed up of a printing speed by applying a charge onto only a part of the surface of the conveyance belt 21 where the recording paper 12 is in contact with the conveyance belt 21 and by performing conveyance at a conveyance speed lower than a predetermined conveyance speed when a charge is applied and performing conveyance at the predetermined speed when a charge is not applied.

For example, when using a recording paper having a high-resistance (a surface resistivity is equal to or $10^{12}\Omega/\square$), which requires slow down of the conveyance speed to 100 mm/sec which is lower than a predetermined conveyance speed of 200 mm/sec, leading and trailing edges are detected so as to perform conveyance at the conveyance speed of 100 mm/sec, which is lower than the predetermined conveyance speed, when a charge is applied and perform conveyance at the predetermined conveyance speed of 200 mm/sec when a charge is not applied.

A description will now be given, with reference to a flowchart of FIG. 9, of a process for performing the above-mentioned process. When a printing process is started, the recording paper 12 is fed (step S1), and it is determined whether or not a part of the surface of the conveyance belt 21 is to be brought into contact with the recording paper 12 (step S2). If it is determined that the part of the surface of the conveyance belt 21 is to be brought into contact with the recording paper 12, an electric charge is applied to the part of the conveyance belt 21 (step S3) and the conveyance belt 21 is moved at a conveyance speed of 100/sec, which is lower than a predetermined conveyance speed (step S4).

On the other hand, if it is determined that the part of the surface of the conveyance belt 21 is not to be brought into contact with the recording paper 12, an electric charge is not applied to the part of the conveyance belt 21 (step S5) and the conveyance belt 21 is moved at the predetermined conveyance speed of 200/sec (step S6).

Then, it is determined whether or not there is a next printing process (step S7). If there is a next printing process, the routine returns to the process of step S1. If there is no next printing process, the process is shifted to a paper eject process (step S8), and the printing process is ended.

Here, a recording medium such as, for example, an overhead projector (OHP) sheet is not required to be attracted by the conveyance belt except for its leading and trailing ends since an OHP sheet has a relatively high rigidity. That is, a relatively rigid recording medium such as an OHP sheet can be conveyed while only leading and trailing ends are attracted. Also in such a case, similar to the above-mentioned example, a speed up of printing can be attempted by conveying at the predetermined conveyance speed (for example, 200 mm/sec) with respect to a portion (middle portion) corresponding to an area where no charge is applied onto the conveyance belt 21, that is, a portion other than the leading and trailing ends of the recording medium that are brought into contact with the conveyance belt).

A description will now be given, with reference to a flowchart of FIG. 10, of a process for performing the above-mentioned process. When a printing process is started, the recording paper 12 is fed (step S11), and it is determined whether or not a part of the surface of the conveyance belt 21 is to be brought into contact with the recording paper 12 (step S12). If it is determined that the part of the surface of the conveyance belt 21 is to be brought into contact with the recording paper 12, an electric charge is applied to the part of the conveyance belt 21 (step S13) and the conveyance belt 21 is moved at a conveyance speed of 100/sec, which is lower than a predetermined conveyance speed (step S14).

Thereafter, it is determined whether or not a portion of the surface of the recording paper contacting the conveyance belt 21 is the middle portion (S15). If the part of the surface of the recording paper 12 is the middle portion, a charge is not applied to the conveyance belt 21 (step S16) and the conveyance belt 21 is moved at the predetermined conveyance speed of 200 mm/sec (step S17). If the part of the surface of the recording paper 12 is not the middle portion, the routine returns to step S12 so as to determined whether or not a part of the surface of the conveyance belt 21 is to be brought into contact with the recording paper 12.

If it is determined in step S12 that a part of the surface of the recording paper 12 is not the contacting surface, an electric charge is not applied to the conveyance belt 21 (step S18) and the conveyance belt 21 is moved at the predetermined conveyance speed of 200 mm/sec (step S19).

Then, it is determined whether or not there is a next printing process (step S20). If there is a next printing process, the routine returns to the process of step S11. If there is no next printing process, the process is shifted to a paper eject process (step S21), and the printing process is ended.

As mentioned above, an attempt can be made to speed up a printing process by changing the conveyance speed in accordance with an existence of positive and negative electric charges applied to the conveyance belt. That is, considering speed up of a printing speed, it is preferable to prevent a reduction in the conveyance speed as much as possible. Thus, an attempt is made to speed up the printing speed by using the predetermined conveyance speed when there in no positive and negative charges applied on the conveyance belt and changing the conveyance speed in accordance with a charge period length when there are positive and negative charges applied on the conveyance belt. Additionally, while stable application of charges is maintained by acquiring an attraction force necessary for conveyance so as to perform a stable application of charges with less fluctuation without destruction of a high-voltage power source and generation of pin holes in the conveyance belt, a high-quality image can be stably formed without an offset of landing positions of ink droplets and a reverse flow of ink mist by suppressing the surface potential.

Figure 11:
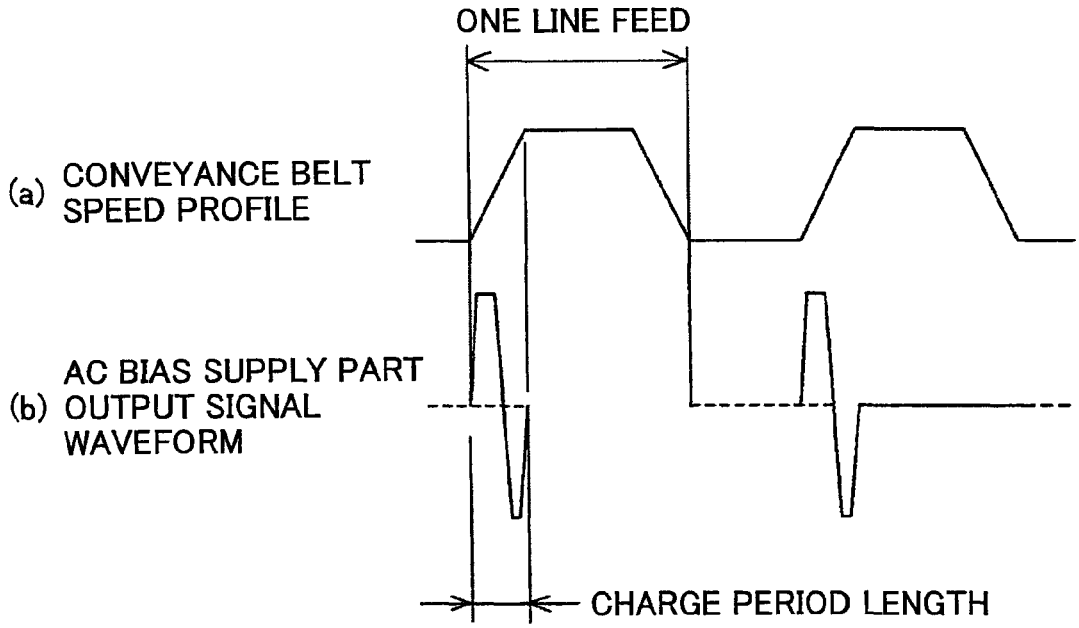
FIG. 11 is a timing chart of a speed profile of a conveyance belt and an output signal waveform of an AC bias supply part of an image forming apparatus according to a third embodiment of the present invention.
Figure 12:
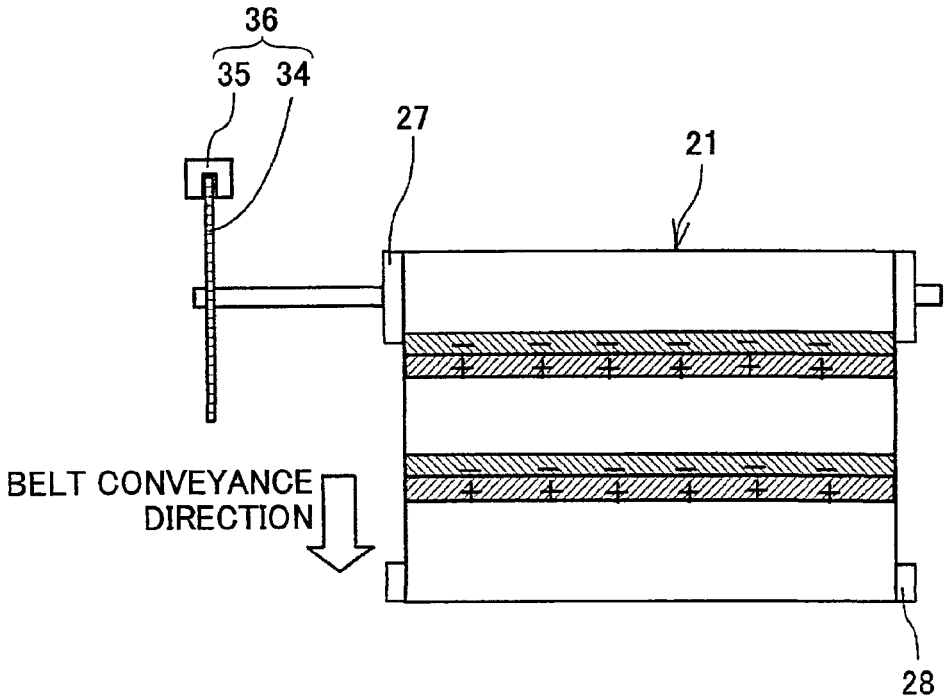
FIG. 12 is an illustration for explaining a charge pattern on the conveyance belt of the image forming apparatus according to the third embodiment of the present invention.

A description will now be given, with reference to FIGS. 11 and 12, of an image forming apparatus according to a third embodiment of the present invention. FIG. 11 is a timing chart showing an example of a speed profile of the conveyance belt and an output signal waveform of the AC bias supply part. FIG. 12 is an illustration for explaining a charge pattern on the conveyance belt.

In the above-mentioned first embodiment, the conveyance speed is adjusted in accordance with the charge period length. That is, when the charge period length is small, a stable attraction is achieved by decreasing the conveyance speed. However, a decrease in the conveyance speed by result in a decrease in a printing speed, and, thus, it is preferable to prevent the conveyance speed from decreasing as much as possible. Considering conveyance, although it is preferable to attract an entire recording paper, a quality and stability of conveyance can be maintained if local attraction areas are provided with a predetermined interval in the direction of conveyance.

Thus, in the third embodiment, using a line feed operation during a printing process, positive and negative charges are applied during a period from a state where the conveyance belt 21 is stopped until a predetermined conveyance speed is attained. The reason for causing the decrease in the conveyance speed when the charge period length is short in the first embodiment is that a total charge amount applied to the conveyance belt 21 is reduced due to a raising loss of the AC bias supply part 114. That is, if a total charge amount applied to the conveyance belt 21 is small, the attraction force between the recording paper 12 and the conveyance belt 21 is small, which causes many problems associated with conveyance. In the present embodiment, attention is given to the fact that, in a line feed operation during a printing process, it takes a time for the conveyance belt 21 to reach at a maximum speed during a line feed operation from a state where the conveyance belt 21 is stopped, if an application of a charge is performed during a period until the conveyance speed of the conveyance belt 21 reaches a predetermined conveyance speed, positive and negative charges can be stably applied onto the conveyance belt without decreasing the printing speed, that is, the maximum speed during the line feed operation.

Specifically, as shown in FIG. 11-(*a*), immediately after a line feed operation is started, a raising of the voltage output signal of the AC bias supply part 114 is started as shown in FIG. 11-(*b*) so as to instantaneously apply one of positive and negative charges onto the conveyance belt 21 via the charge roller 26 and subsequently apply the other of positive and negative charges onto the conveyance belt 21.

Then, when the conveyance speed of the conveyance belt 21 reaches a predetermined conveyance speed, the voltage output signal is stopped so as to end the application of charges to the conveyance belt 21. After completion of the line feed operation, ink droplets are discharged from the recording head 7 so as to form an image corresponding to one reciprocation cycle of the head on the recording paper attracted by the conveyance belt 21. After completion of the image, a next line feed operation is started.

After the start of the next line feed operation, a voltage output signal is output from the AC bias supply part 114 so as to apply a pair of positive and negative charges onto the conveyance belt 21 in the same manner mentioned above.

Thus, if the positive and negative charges are applied to the conveyance belt 21 to be adjacent to each other, positive and negative charges adjacent to each other are also induced on the recording paper 12 that is in contact with the conveyance belt 21, and, thereby, exchange of the charges is promoted, which reduces a time until the positive and negative charges are reduced by being cancelled with each other. Thus, the recording paper 12 can be more quickly and strongly attracted by the conveyance belt 21.

As mentioned above, by repeating the application of the charges during the period from the state where the conveyance belt 21 is stopped until the predetermined speed is reached, the charge pattern of pairs of positive and negative charges with a predetermined interval is formed on the conveyance belt 21 as shown in FIG. 12, which enables acquisition of the attraction force necessary for conveyance.

It should be noted that although the application of charges continues until the conveyance speed of the conveyance belt 21 reaches a maximum speed in the figure for the sake of easy understanding of the description, the same effect may be acquired if the application of charges is ended before the conveyance speed reaches the maximum speed depending on the relationship between the conveyance speed and the charge period length.

Additionally, although the description was given of the example in which a pair of positive and negative charges are applied during one line feed operation from the state where the conveyance belt is stopped until the predetermined conveyance speed is reached, the recording paper may be more effectively attracted by the conveyance belt if a plurality of pairs of positive and negative charges are applied during a time period for raising the conveyance speed.

By applying positive and negative charges onto the conveyance belt during the line feed operation from the state where the conveyance belt is stopped until the predetermined conveyance speed is reached, a stable application of charges can be performed on the conveyance belt without decreasing the printing speed even in the case where the charge period length is short. Additionally, while stable application of charges is maintained by acquiring an attraction force necessary for conveyance so as to perform a stable application of charges, a high-quality image can be stably formed without an offset of landing positions of ink droplets and a reverse flow of ink mist by suppressing the surface potential.

That is, if the conveyance speed is changed in accordance with the charge period length so as to stably apply positive and negative charges onto the conveyance belt, that is, if an attempt is made to acquire a stable attraction by decreasing the conveyance speed when the charge period length is short, the printing speed may be reduced. Thus, by using the line feed operation during the printing process and performing application of the positive and negative charges are applied during the period from the state where the conveyance belt is stopped until the predetermined conveyance speed is reached, the positive and negative charges can be stably applied onto the conveyance belt without decreasing the printing speed even in the case where the charge period length is short, and while stable maintaining a stable conveyance performance by acquiring an attraction force necessary for conveyance, a high-quality image can be stably formed without an offset of landing positions of ink droplets and a reverse flow of ink mist.

Figure 13:
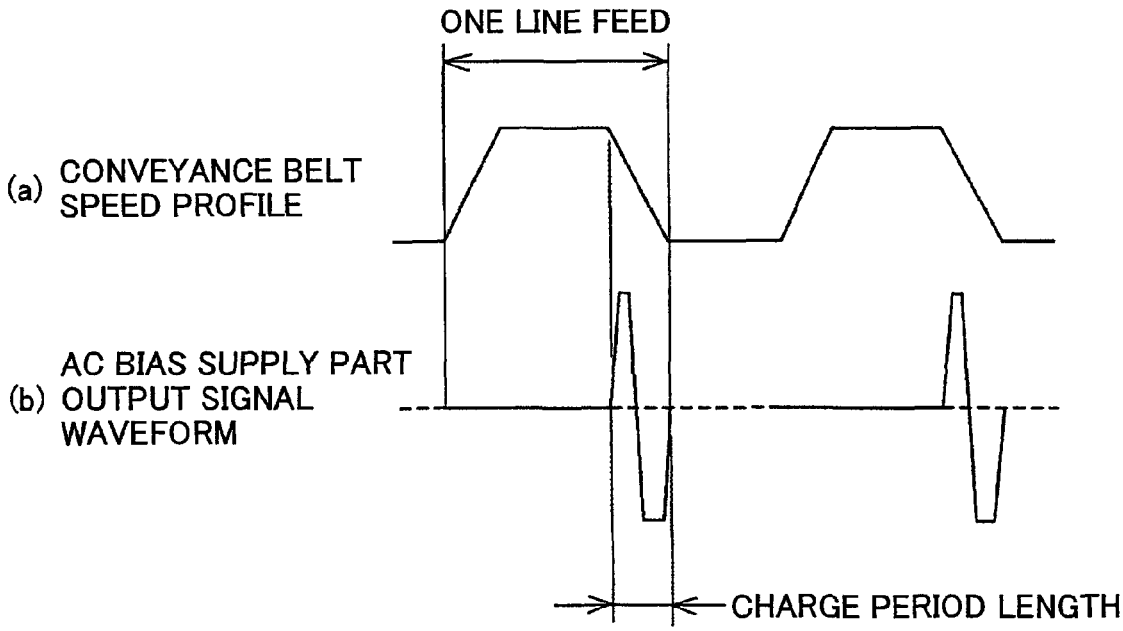
FIG. 13 is a timing chart of a speed profile of a conveyance belt and an output signal waveform of an AC bias supply part of an image forming apparatus according to a fourth embodiment of the present invention.
Figure 14:
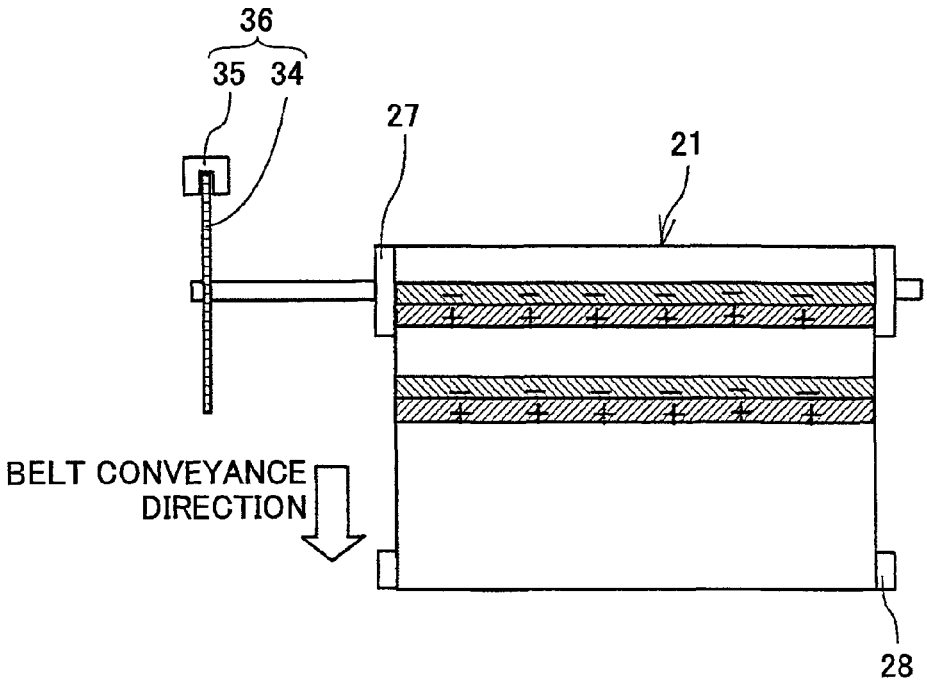
FIG. 14 is an illustration for explaining a charge pattern on the conveyance belt of the image forming apparatus according to the fourth embodiment of the present invention.

A description will now be given, with reference to FIGS. 13 and 14, of an image forming apparatus according to a fourth embodiment of the present invention. FIG. 13 is a timing chart showing an example of a speed profile of the conveyance belt and an output signal waveform of the AC bias supply part. FIG. 14 is an illustration for explaining a charge pattern on the conveyance belt.

In the above-mentioned third embodiment, positive and negative charges can be applied to the conveyance belt 21 without decreasing the conveyance speed, that is, a maximum speed during a line feed operation, by applying electric charges at a period from a state where the conveyance belt is stopped until a predetermined conveyance speed is reached in a line feed operation. This uses the fact that the conveyance speed is low during a period for raising the conveyance speed to the predetermined speed since it takes a considerable time to raise the conveyance speed.

On the other hand, in the fourth embodiment, attention is given to the fact that the conveyance speed is also low during a period from the state where the conveyance belt 21 is at the predetermined speed until the conveyance belt 21 is stopped in a line feed operation, and the positive and negative charges are applied to the conveyance belt 21 without decreasing the conveyance speed, that is, a maximum speed during a line feed operation, by applying electric charges at a period from a state where a predetermined conveyance belt is reached until the conveyance belt is stopped in a line feed operation.

Specifically, although charges are applied during the speed increasing period from the state where the conveyance belt 21 is stopped until the conveyance belt reaches a predetermined state in a line feed operation in the above-mentioned third embodiment, charges are applied during the speed decreasing period from the state where the conveyance belt 21 is moving at a predetermined speed until the conveyance belt 21 is stopped during a line feed operation in the present embodiment as shown in FIG. 13. For this reason, as shown in FIG. 14, a charge pattern in which pairs of the positive and negative charges are arranged at a predetermined interval, is formed on the conveyance belt 21.

By applying positive and negative charges onto the conveyance belt during a line feed operation from the state where the conveyance belt is at a predetermined conveyance speed until the conveyance belt is stopped, a stable application of charges can be performed on the conveyance belt without decreasing the printing speed even in the case where the charge period length is short. Additionally, while stable application of charges is maintained by acquiring an attraction force necessary for conveyance so as to perform a stable application of charges, a high-quality image can be stably formed without an offset of landing positions of ink droplets and a reverse flow of ink mist by suppressing the surface potential.

That is, if the conveyance speed is changed in accordance with the charge period length so as to stably apply positive and negative charges onto the conveyance belt, that is, if an attempt is made to acquire a stable attraction by decreasing the conveyance speed when the charge period length is short, the printing speed may be reduced. Thus, by using a line feed operation during the printing process and performing application of the positive and negative charges are applied during the period from the state where the conveyance belt is at a predetermined conveyance speed until the conveyance belt is stopped, the positive and negative charges can be stably applied onto the conveyance belt without decreasing the printing speed even in the case where the charge period length is short, and while stable maintaining a stable conveyance performance by acquiring an attraction force necessary for conveyance, a high-quality image can be stably formed without an offset of landing positions of ink droplets and a reverse flow of ink mist.

Figure 15:
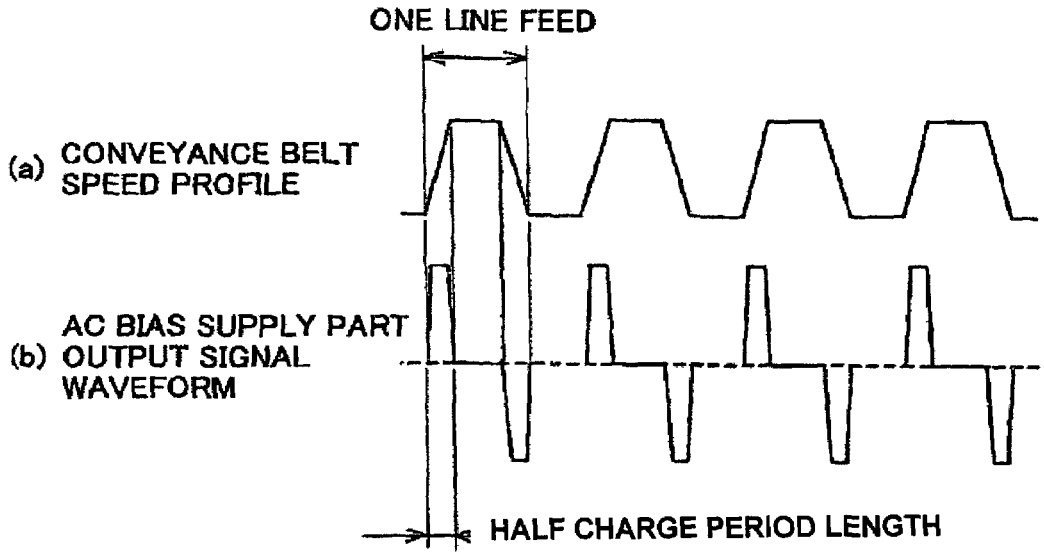
FIG. 15 is a timing chart of a speed profile of a conveyance belt and an output signal waveform of an AC bias supply part of an image forming apparatus according to a fifth embodiment of the present invention.
Figure 16:
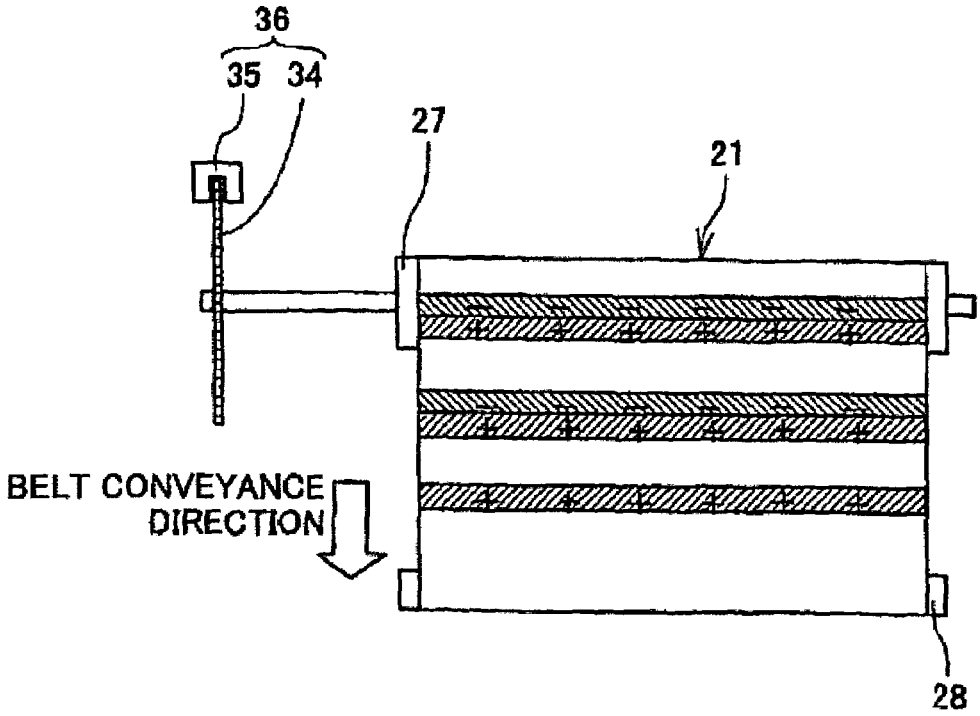
FIG. 16 is an illustration for explaining a charge pattern on the conveyance belt of the image forming apparatus according to the fifth embodiment of the present invention.

A description will now be given, with reference to FIGS. 15 and 16, of an image forming apparatus according to a fifth embodiment of the present invention. FIG. 15 is a timing chart showing an example of a speed profile of the conveyance belt and an output signal waveform of the AC bias supply part. FIG. 16 is an illustration for explaining a charge pattern on the conveyance belt.

In the above-mentioned third embodiment, positive and negative charges can be applied to the conveyance belt 21 without decreasing the conveyance speed, that is, a maximum speed during a line feed operation, by applying electric charges at a period from a state where the conveyance belt 21 is stopped until a predetermined conveyance speed is reached in a line feed operation. Similarly, in the above-mentioned fourth embodiment, positive and negative charges can be applied to the conveyance belt 21 without decreasing the conveyance speed, that is, a maximum speed during a line feed operation, by applying electric charges at a period from a state where the conveyance belt 21 is at a predetermined conveyance speed until the conveyance belt is stopped.

On the other hand, in the fifth embodiment, positive and negative charges are applied to the conveyance belt 21 without decreasing the conveyance speed, that is, a maximum speed during a line feed operation, so that more charges can be applied to the conveyance belt than the third and fourth embodiments, by applying electric charges at a period from a state where a predetermined conveyance belt 21 is reached until the conveyance belt 21 is stopped in a line feed operation and at a period from a state where the conveyance belt 21 is at the predetermined speed until the conveyance belt 21 is stopped.

Specifically, although charges are applied during the speed increasing period from the state where the conveyance belt 21 is stopped until the conveyance belt reaches a predetermined state in a line feed operation in the above-mentioned third embodiment or during the speed decreasing period from the state where the conveyance belt 21 is at the predetermined speed until the conveyance belt 21 is stopped in a line feed operation in the above-mentioned fourth embodiment, charges are applied during the speed decreasing period from the state where the conveyance belt 21 is moving at a predetermined speed until the conveyance belt 21 is stopped during a line feed operation and also during the speed decreasing period from the state where conveyance belt 21 is at the predetermined speed until the conveyance belt 21 is stopped, as shown in FIG. 15.

Moreover, although a stable attraction force cannot be obtained unless at least a pair of positive and negative charges are applied during one speed increasing period or one speed decreasing period in the third and fourth embodiment, an attraction force which can achieve a stable conveyance can be obtained even if at least one pair of positive and negative charges is not applied during one opportunity for applying charges in the present embodiment since positive and negative charges can be applied adjacent to each other on the conveyance belt 21 as shown in FIG. 15 if charges of opposite polarities are applied during the speed decreasing period and the speed increasing period, respectively. As a result, charges are applied on the conveyance belt 21 in a charge pattern as shown in FIG. 16.

Moreover, although charges are applied consecutively during both the speed decreasing period and the speed increasing period, an effect corresponding to an amount of charges applied can be obtained if the charges are not applied consecutively.

As mentioned above, by applying positive and negative charges onto the conveyance belt in a line feed operation during a period from the state where the conveyance belt is at a predetermined speed until the conveyance belt is stopped and also a period from the state where the conveyance belt is at a predetermined conveyance speed until the predetermined conveyance speed is stopped, a stable application of charges can be performed on the conveyance belt without decreasing the printing speed even in the case where the charge period length is short. Additionally, while stable application of charges is maintained by acquiring an attraction force necessary for conveyance so as to perform a stable application of charges, a high-quality image can be stably formed without an offset of landing positions of ink droplets and a reverse flow of ink mist by suppressing the surface potential.

That is, if the conveyance speed is changed in accordance with the charge period length so as to stably apply positive and negative charges onto the conveyance belt, that is, if an attempt is made to acquire a stable attraction by decreasing the conveyance speed when the charge period length is short, the printing speed may be reduced. Thus, by using a line feed operation during the printing process and performing application of the positive and negative charges are applied the period where the conveyance belt is at the predetermined speed until the conveyance belt is stopped and also during the period from the state where the conveyance belt is at a predetermined conveyance speed until the conveyance belt is stopped, the positive and negative charges can be stably applied onto the conveyance belt without decreasing the printing speed even in the case where the charge period length is short, and while stable maintaining a stable conveyance performance by acquiring an attraction force necessary for conveyance, a high-quality image can be stably formed without an offset of landing positions of ink droplets and a reverse flow of ink mist.

Figure 17:
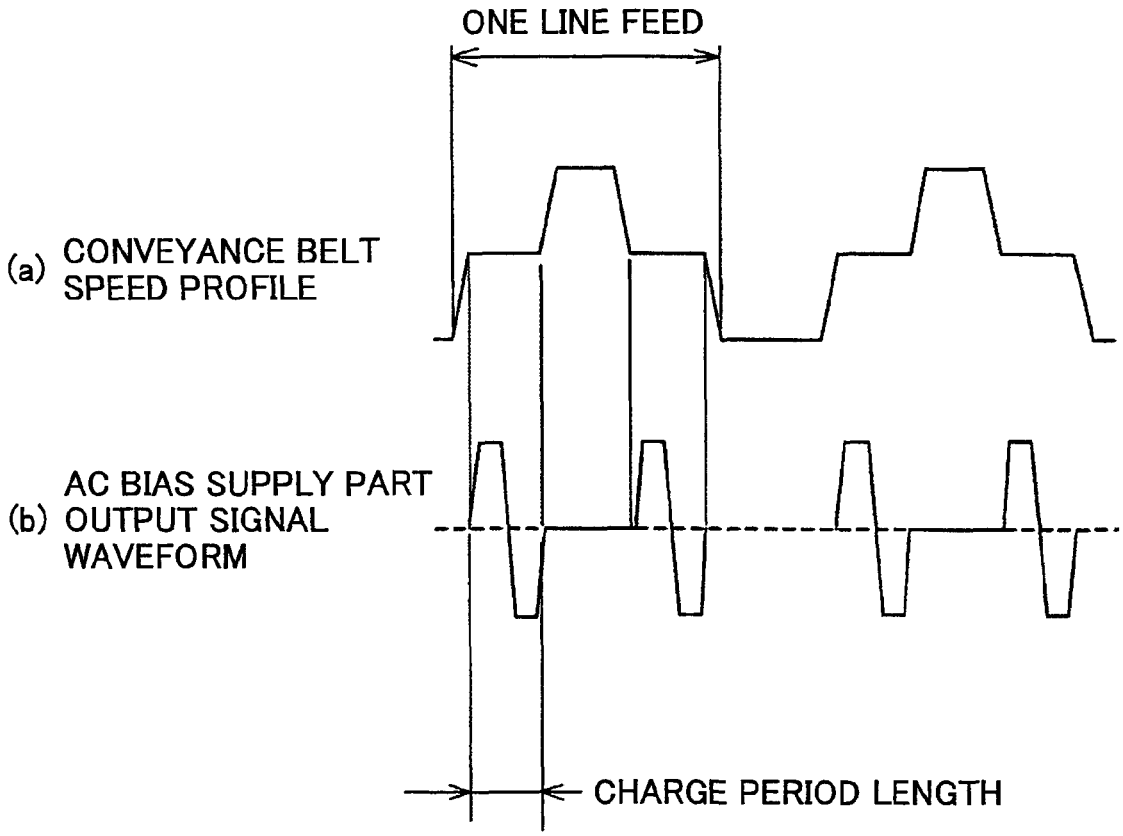
FIG. 17 is a timing chart of a speed profile of a conveyance belt and an output signal waveform of an AC bias supply part of an image forming apparatus according to a sixth embodiment of the present invention.

A description will now be given, with reference to FIG. 17, of an image forming apparatus according to a fifth embodiment of the present invention. FIG. 17 is a timing chart showing an example of a speed profile of the conveyance belt and an output signal waveform of the AC bias supply part.

In the above-mentioned third, fourth and fifth embodiment, charges are applied to the conveyance belt 21 when the conveyance speed is lower than a predetermined conveyance speed during a period from the conveyance belt 21 is stopped until the conveyance belt 21 reaches the predetermined conveyance speed and/or a period from a state where the conveyance belt 21 is at the predetermined conveyance speed until the conveyance belt 21 is stopped in a line feed operation so as to apply the charges to the conveyance belt 21 without giving influences to the printing speed when the charge period length is small.

However, since the electric charges are applied during the increasing period and/or the decreasing period of the conveyance speed, an amount of charges applied onto the conveyance belt may fluctuate, and the charge period length of the positive and negative charges applied onto the conveyance belt 21 may also fluctuate.

Thus, in the present embodiment, positive and negative charges are applied stably onto the conveyance belt 21 by applying the charges in an area where the conveyance speed is constant in a line feed operation. That is, as shown in FIG. 17, an area where the conveyance speed becomes constant is provided in a line feed operation so as to apply positive and negative charges in the area the conveyance speed is constant. In such as case, a multiple of one cycle of positive and negative charges (two cycles in this example) are applied. Additionally, by applying positive and negative charges at least one pair, preferably, a multiple of pairs as in this embodiment, cancellation of charges induced on a recording paper can be promoted, which enables to acquire a stronger attraction force. Thus, an attempt can be made to achieve both an attraction force necessary for conveyance and suppression of a surface potential, and a high-quality image can be stably formed without an offset in landing positions of ink droplets and a reverse flow of ink mist toward a recording head.

That is, in order to perform a stable conveyance more efficiently, it is effective to improving the attraction force between the conveyance belt and a recording paper by canceling charges induced by charges applied onto the conveyance belt. Thus, by applying positive and negative charges at least one pair, preferably, a multiple of pairs, the cancellation of the charges induced on a recording paper can be promoted, which generates a stronger attraction force, and, thereby, while maintaining an attraction force necessary for conveyance, a high-quality image can be stably formed without an offset in landing positions of ink droplets and a reverse flow of ink mist toward a recording head.

The present invention is not limited to the specifically disclosed embodiment, and variations and modifications may be made without departing from the cope of the present invention.

The invention claimed is:

1. An image forming apparatus comprising:

a conveyance belt that conveys a recording medium by attracting the recording medium by an electrostatic force; and a recording head that discharges liquid droplets toward the recording medium being conveyed by the conveyance belt at a conveyance speed, wherein the image forming apparatus further comprises:

a charging part that applies alternating positive and negative electric charges onto said conveyance belt; and a control part that controls said conveyance speed and controls said charging part to apply the charge only when said conveyance speed is less than a maximum conveyance speed during a line feed operation, wherein said charging part applies the positive and negative electric charges only during a period from a state where said conveyance belt is stopped until said maximum conveyance speed is reached.

2. The image forming apparatus as claimed in claim 1, wherein said charging part applies at least one or more pairs of the positive and negative electric charges.

3. The image forming apparatus as claimed in claim 1, wherein when the predetermined conveyance speed for conveying the recording medium is higher than a conveyance speed corresponding to a predetermined period length, said charging part applies the positive and negative electric charges during a period from a state where said conveyance belt is stopped until said maximum conveyance speed is reached and a period from a state where said conveyance belt is at said predetermined conveyance speed until said conveyance belt is stopped.

4. The image forming apparatus as claimed in claim 1, wherein said control part controls said charging part to stop applying the charges when the conveyance speed reaches the maximum speed.

5. The image forming apparatus as claimed in claim 1, wherein said charging part applies the positive and negative electric charges during a period that the conveyance speed of the conveyance belt is increasing.

6. An image forming apparatus comprising:

a conveyance belt configured to convey a recording medium by attracting the recording medium by an electrostatic force;

a recording head configured to discharge liquid droplets toward the recording medium being conveyed by the conveyance belt at a conveyance speed;

a charging part configured to apply alternating positive and negative electric charges onto said conveyance belt; and a control part configured to control said conveyance speed and control said charging part to apply the charge only when said conveyance speed is less than a maximum conveyance speed during a line feed operation, wherein said charging part applies the positive and negative electric charges only during a period from a state where said conveyance belt is at said maximum conveyance speed until said conveyance belt is stopped.

7. The image forming apparatus as claimed in claim 6, wherein said charging part applies at least one or more pairs of the positive and negative electric charges.

8. The image forming apparatus as claimed in claim 6, wherein said charging part applies at least one or more pairs of the positive and negative electric charges.

9. The image forming apparatus as claimed in claim 6, wherein when a predetermined conveyance speed for conveying the recording medium is higher than a conveyance speed corresponding to a predetermined period length, said charging part applies the positive and negative electric charges during a period from a state where said conveyance belt is stopped until said maximum conveyance speed is reached and during a period from a state where said conveyance belt is at said predetermined conveyance speed until said conveyance belt is stopped.

10. The image forming apparatus as claimed in claim 9, wherein said charging part applies at least one or more pairs of the positive and negative electric charges.

11. The image forming apparatus as claimed in claim 6, wherein said control part controls said charge period of positive and negative electric charges only when said conveyance speed for conveying the recording medium is higher than a conveyance speed according to a predetermined period length.

12. The image forming apparatus as claimed in claim 6, wherein said control part controls said charging part to stop applying the charges when the conveyance speed reaches the maximum speed.

13. The image forming apparatus as claimed in claim 6, wherein said charging part applies the positive and negative electric charges during a period that the conveyance speed of the conveyance belt is decreasing.

14. An image forming apparatus comprising:

a conveyance belt configured to convey a recording medium at a conveyance speed by attracting the recording medium to the conveyance belt by an electrostatic force;

a recording head configured to discharge liquid droplets toward the recording medium attracted to the conveyance belt;

a charging part configured to apply alternating positive and negative electric charges onto the conveyance belt; and a control part configured to control said conveyance speed and control said charging part, wherein the conveyance speed of the conveyance belt is controlled by the control part to perform a line feed operation consisting of, in order, a period of stopped motion, a period of increasing speed, a period of predetermined maximum speed, a period of decreasing speed, and a period of stopped motion and the charging part is controlled by the control part to apply the positive and negative charges only during at least one of the period of increasing speed and the period of decreasing speed.

* * * * *

UNITED STATES PATENT AND TRADEMARK OFFICE

CERTIFICATE OF CORRECTION

PATENT NO. : 7,731,322 B2
APPLICATION NO. : 11/963181
DATED : June 8, 2010
INVENTOR(S) : Seiichi Kogure and Shinji Imoto It is certified that error appears in the above-identified patent and that said Letters Patent is hereby corrected as shown below:

On the title page replace Item (63) with the following:

Item --(63) Related U.S. Application Data
Division of application No. 10/561,329, filed on
Dec. 19, 2005, now Pat. No. 7,334,858, which is
a Section 371 of application No.
PCT/JP2005/008267, filed on April 22, 2005--

Signed and Sealed this

Twenty-third Day of November, 2010

David J. Kappos

David J. Kappos
*Director of the United States Patent and Trademark Office*